US007036434B1

(12) United States Patent
Vo et al.

(10) Patent No.: US 7,036,434 B1
(45) Date of Patent: May 2, 2006

(54) KINETIC ENERGY PROJECTILE WITH IN-FLIGHT EXTENDED LENGTH

(75) Inventors: Daniel Vo, Landing, NJ (US); Leon Manole, Great Meadows, NJ (US); Michael Donadio, West Milford, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 164 days.

(21) Appl. No.: 10/709,286

(22) Filed: Apr. 27, 2004

Related U.S. Application Data

(60) Provisional application No. 60/481,971, filed on Jan. 30, 2004.

(51) Int. Cl.
*F42B 14/06* (2006.01)

(52) U.S. Cl. ..... 102/522; 102/503; 102/520

(58) Field of Classification Search ..... 102/439, 102/503, 510, 520, 521, 522
See application file for complete search history.

(56) References Cited

U.S. PATENT DOCUMENTS 2,324,551 A * 7/1943 Albree ..... 244/3.1
3,256,816 A * 6/1966 Pilcher, II ..... 102/374
3,842,741 A * 10/1974 Brothers et al. ..... 102/490
4,242,960 A * 1/1981 Boeder et al. ..... 102/506
4,624,187 A * 11/1986 Bocker et al. ..... 102/520
4,706,569 A * 11/1987 Wallow et al. ..... 102/518
4,964,341 A * 10/1990 Hebert ..... 102/501
6,492,632 B1 * 12/2002 Pollin ..... 244/3.3

FOREIGN PATENT DOCUMENTS

JP 5-118795 * 5/1993

* cited by examiner

*Primary Examiner*—Peter M. Poon
*Assistant Examiner*—David Parsley
(74) *Attorney, Agent, or Firm*—Michael C Sachs; John F. Moran

(57) ABSTRACT

A length of a rod of an axial kinetic energy projectile is increased as the projectile flies to the target. The projectile includes a nose, a rear, and a base rod. The base rod has a forward member, a rearward member, and a connection between the forward member and the rearward member which allows the forward member to move axially relative to the rearward member from a contracted position where the rod has a reduced length to an extended position where the rod has an increased length greater than the contracted length. Further, the base rod includes a locking mechanism which axially locks the forward member and the rearward member together when the forward member is moved from the contracted position to the extended position.

3 Claims, 5 Drawing Sheets

KINETIC ENERGY PROJECTILE WITH IN-FLIGHT EXTENDED LENGTH

CROSS REFERENCE TO RELATED APPLICATIONS

This application claims benefit under 35 USC 119(e) of provisional application 60/481,971, filed Jan. 30, 2004, the entire file wrapper contents of which provisional application are herein incorporated by reference as though fully set forth at length.

FEDERAL RESEARCH STATEMENT

The inventions described herein may be manufactured, used and licensed by or for the U.S. Government for U.S. Government purposes.

BACKGROUND OF INVENTION

Depicted in FIG. 1 is a cutaway view of a kinetic energy (KE) projectile 10 of the prior art as part of a cartridge 12 chambered in a gun tube 14. As well known in the art, projectile 10 is comprised of a sabot 16, a projectile nose 18, a solid projectile base rod 20 and a rear fin section 22. Nose 18 is attached to rod 20 by threads (not shown) and fin section 22 is attached to rod 20 by threads (not shown). Sabot 16 is attached to rod 20 by threads or buttress grooves (not shown). Projectile 10 is referred to as an in-bore KE projectile due to the fact that it has sabot 16 attached to projectile rod 16.

Cartridge 12 consists of projectile 10 which is attached to an obturator 24, which obturator 24 is in turn attached to a cartridge case 26. Cartridge case 26 contains a primer 28 and a propellant 30. Primer 28 is used to ignite propellant 30 in cartridge case 26. Following ignition of propellant 30, in-bore projectile 10 travels up gun tube 10 and then exits gun tube 10. This propellant/projectile/gun tube interface is what determines the velocity of the in-flight projectile.

In-flight, projectile 10 does not have sabot 16 attached. Instead, in-flight projectile 10 is comprised of nose 18, rod 20 and fin section 22. The function of sabot 16 is to fill gun tube 14 during launch and to carry projectile 10. Once in-bore projectile 10 exits gun tube 14, sabot 16 is discarded and in-flight projectile 10 continues on to the target—which is typically heavy armor. Upon impact with the target, rod 20, usually made of tungsten or depleted uranium (DU), defeats the target by penetrating it and passing through it.

It is the kinetic energy of projectile 10, the shape of projectile 10, and the angle of impact and material of rod 20 that determine the thickness of armor that rod 20 penetrates. Various attempts have been made to change one or more of these factors to increase the thickness of armor that can be defeated.

For example, one known way to increase the penetration capability of rod 20 is to increase the length of rod 20. However, since rod 20 in cartridge 12 usually is at a maximum length to fit within cartridge 12 already and/or for cartridge 12 to fit in the gun, increasing the length of rod 20 in cartridge 12 is not an option.

SUMMARY OF INVENTION

With the present invention, there has been found a way to increase the length of a rod of a kinetic energy projectile as the projectile flies to the target. Thus, in the illustrated embodiments, an axial kinetic energy projectile is provided having a nose provided at a forward end, a rear provided at a rearward end, and a base rod provided between the nose and rear. This base rod includes a forward member integral with the nose, a rearward member integral with the rear, and a connection between the forward member and the rearward member which allows the forward member to move axially relative to the rearward member from a contracted position where the rod has a reduced length to an extended position where the rod has an increased length greater than the contracted length. Further, the base rod includes a locking mechanism which axially locks the forward member and the rearward member together when the forward member is moved from the contracted position to the extended position.

In the illustrated embodiments, a portion of one of the forward member and the rearward member is received axially within a portion of the other. In some illustrated embodiment, the connection is a sliding fit of the portions of the rearward and forward members. With this sliding fit, in one particular illustrated embodiment, a chamber is provided between the portions, and a propellant is located in the chamber which is ignited after firing of the projectile to move the forward member from the contracted to the extended position. In another particular illustrated embodiment, the sliding fit between the portions permits the forward member to move from the contracted to the extended position as a result of the set forward force after firing of the projectile.

In one illustrated embodiment, the locking mechanism includes an enlarged part of one of the portions of the rearward and forward members, and a reduced part of the other of the portions of the rearward and forward members in which the enlarged part is received when the forward member is moved from the contracted position to the extended position.

In another illustrated embodiment, the rear includes a spinning mechanism which spins the projectile after firing in one spin direction, and the connection is respective mating threads on the portions of the rearward and forward members. The mating threads have a thread direction opposite to that of the spin direction, so that after firing the spinning mechanism causes the forward member to be threadably moved from the contracted position to the extended position. As also illustrated, the locking mechanism can be a thread lock.

In still another illustrated embodiment, the projectile includes a reinforcing member located in the rod between the forward member and the rearward member. Thus, when the rearward member is moved from the contracted position to the extended position, the reinforcing member presses against an outer wall of the rod to help prevent bowing of the outer wall during flight. Conveniently, as illustrated, the reinforcing member is resilient.

It is an advantage of the present invention that the in-flight length of a projectile is increased.

It is also an advantage of the present invention that the lengthened projectile is able to defeat thicker armor or to create a larger penetrating hole in a target.

Other features and advantages of the present invention are stated in or apparent from detailed descriptions of presently preferred embodiments of the invention found hereinbelow.

DETAILED DESCRIPTION

Figure 1:
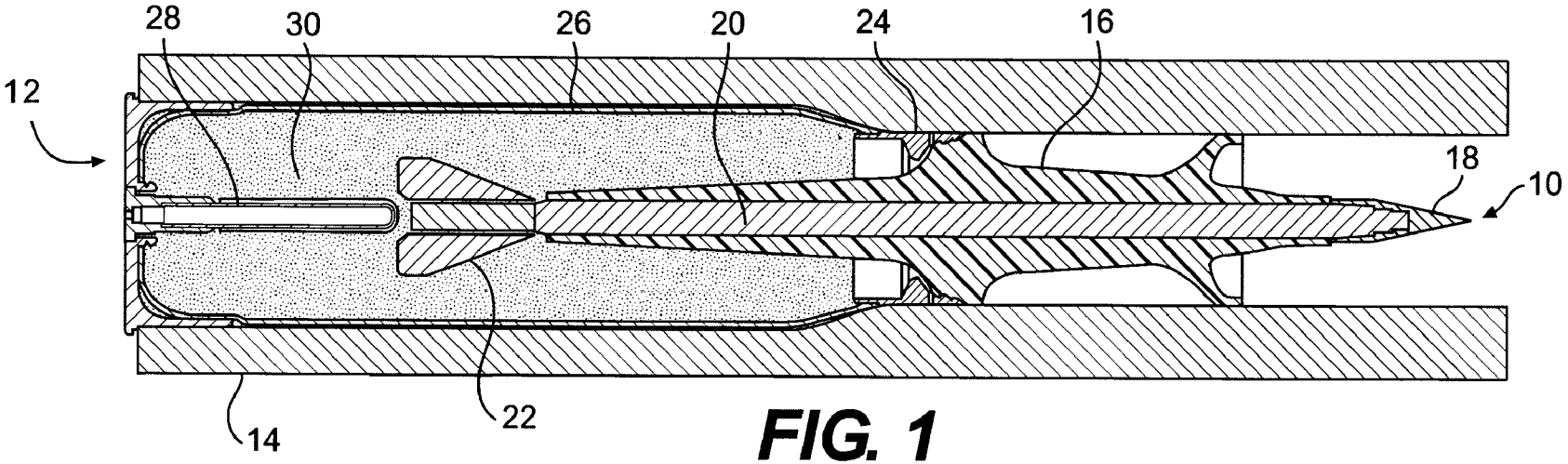
FIG. 1 PRIOR ART
FIG. 1 is a cross-sectional side elevation view of a prior art cartridge containing projectile ready for firing from a gun tube.
Figure 2:
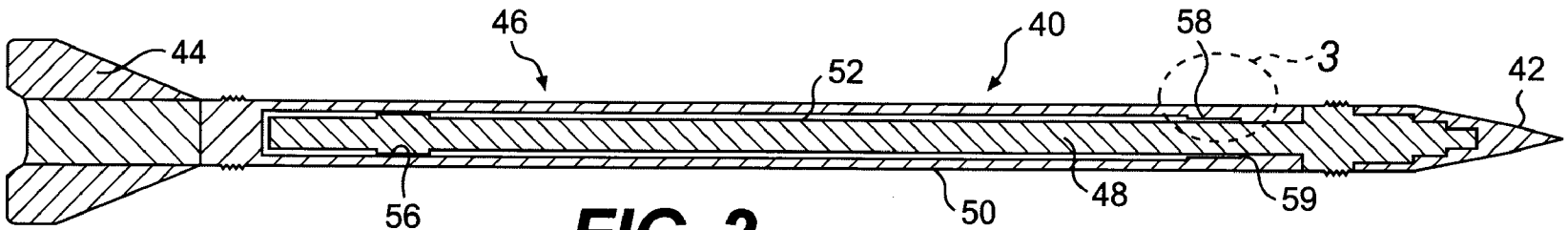
FIG. 2 is a cross-sectional side elevation view of a first projectile prior to firing in accordance with the present invention.

With reference now to the drawings in which like numerals represent like elements throughout the views, a first embodiment of a projectile 40 in accordance with the present invention is depicted in FIG. 2. Projectile 40 is depicted separate from a cartridge or the like, but in use would be provided together with a cartridge in the same manner known in the art as prior art projectile 10 discussed above. Similar to projectile 10, projectile 40 includes a nose 42, a rear 44 having a standard fin section, and a base rod 46 made of tungsten or DU. It will be appreciated that the main difference between projectile 10 of the prior art and projectile 40 of the present invention is in the construction and operation of base rod 46 which allows for the overall length of projectile 40 to be increased after firing.

Figure 4:
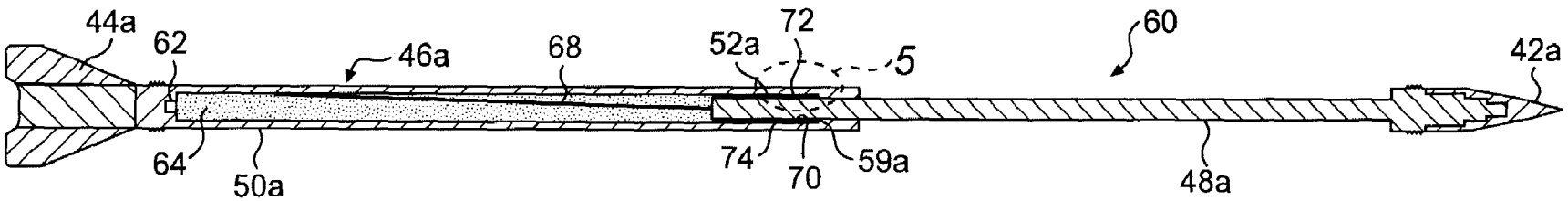
FIG. 4 is a cross-sectional side elevation view of a second projectile after firing.

With the present invention, base rod 46 is formed in two parts, a forward member 48 to which nose 42 is threadably attached and a rearward member 50 to which rear 44 is threadably attached. A connection 52 is then provided which allows forward member 48 to move axially relative to rearward member 50. This allowed movement is between a contracted position as shown in FIG. 2 and an extended position, which extended position is shown in FIG. 4 by a similar but slightly different projectile 60 (as described subsequently). In this embodiment shown in FIG. 2, connection 52 is formed by a portion of forward member 48 which is received axially within a portion of rearward member 50 to provide a sliding/guiding fit therebetween. However, it will be appreciated that the configuration of connection 52 could be reversed if desired with the rearward member received in the forward member, or that the configuration of connection 52 could even be other connections which accommodate some sort of guiding/movable fit.

Figure 3:
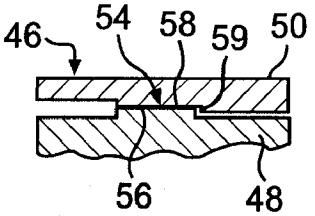
FIG. 3 is an exploded portion of the projectile of FIG. 3 shown by broken circle 3 in FIG. 2.

It will be appreciated that base rod 46 of projectile 40 also includes a locking mechanism 54 shown best in FIG. 3 which axially locks forward member 48 and rearward member 50 together after forward member 48 is moved from the contracted position to the extended position. In this embodiment, locking mechanism 54 includes an enlarged part which is this embodiment is a projecting ring portion 56 of forward member 48 and a matingly shaped reduced part which is this embodiment is a cylindrical groove portion 58 of rearward member 50 which is followed by a shoulder (slightly reduced diameter) 59 of rearward member 50 serving as a positive stop for the forward movement of ring portion 56.

In operation, projectile 40 is loaded in a conventional cartridge (not shown) so that this cartridge (including projectile 40) has the same essential profile and dimensions as a similar prior art cartridge 12 (and prior art projectile 10). Then, during gun launch with all other things being essentially equal, projectile 40 is launched in the same manner as projectile 10 with the same velocity and kinetic energy. The sabot 16 is discarded after gun launch in the same conventional manner in projectile 40 as in projectile 10. However, after gun launch of projectile 40, the set forward force of forward member 48 relative to rearward member 50 causes forward member 48 to move from the contracted position shown in FIG. 2 to the extended position (as similarly depicted in FIG. 4). As known to those of ordinary skill in the art, the setback force of a fired projectile is the force that is exerted on the projectile upon shot start and that causes an initial compression force on the projectile; whereas set forward force is the force that is exerted on the projectile when the projectile leaves the gun and is an opposite tension force to the initial compression force. It will be appreciated that the sliding fit of connection 52 between forward member 48 and rearward member 50 is not so tight that a vacuum is created behind forward member 48 as it moves from the contracted position to the extended position due to the set forward force.

The forward movement of forward member 48 is allowed after firing due to the sliding fit of connection 52 between forward member 48 and rearward member 50. Further, due to the dimensional tolerances of ring portion 56 and groove portion 58, ring portion 56 is press fit and finally fully received into groove portion 58 as shown in FIG. 3. This occurs during the forward sliding and guided movement of forward member 48 from the contracted position to the extended position, where the forward movement of forward member 48 locking forward member 48 in the extended position relative to rearward member 50 is stopped as shoulder portion 59 is engaged. Thus, during flight to the target, the length of projectile 40 is increased so that the penetration capability of projectile 40 is increased relative to similar projectile 10 having a shorter (as measured in-flight) length. For an increase in length of 50% of a projectile, it is known that there will be an increase penetration of an armored target of up to 20%. Therefore, with forward member 48 moved to the extended position, an increase of 20% in penetration is expected for projectile 40 relative to the similar projectile 10 which is not extended in any way.

Depicted in FIG. 4 is a projectile 60 in accordance with a second embodiment of the present invention. Projectile 60 is mostly similar to projectile 40, so that the same elements have been identified with the same numerals with an added "a", and consequently such elements are not discussed further. A first difference between projectile 40 and projectile 60 is the manner in which forward member 48*a* is moved from the contracted to the extended position. In this embodiment, projectile 60 includes a small chamber 62 adjacent rear 44*a* in which a propellant 64 (originally a grain but depicted in the expanded gaseous form after ignition) is received. Propellant 64 is conveniently ignited slightly after and by the main propellant of the cartridge, so that propellant 64 expands and drives forward member 48*a* away from rear 44*a* and hence from the contracted to the extended position.

Figure 5:
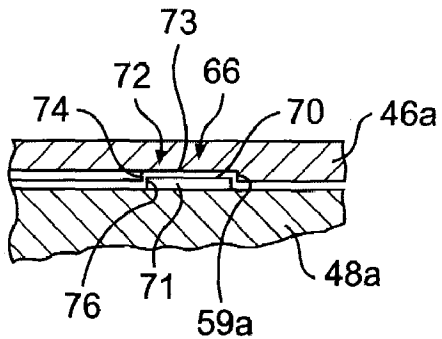
FIG. 5 is an exploded portion of the projectile of FIG. 4 shown by broken circle 5 in FIG. 4.

Projectile 60 also differs from projectile 40 in the construction of locking mechanism 66 as shown best in FIG. 5.

In this embodiment, locking mechanism 66 induces a 90° or so turn of forward member 48*a* as locking mechanism 66 ends the forward motion thereof. This turning motion is accomplished by one or more ridges 68 or the like provided at the forward end of rearward member 50*a*. Locking mechanism 66 also includes a twist-lock type of locking by use of a ring portion 70 which is divided radially into quadrants 71 (or greater or less numbers of raised portions as desired) with groove portion 72 having a likewise number (four) of openings 73 into which the quadrants 71 of ring portion 70 are initially received and preferably ride thereinto by the positioning of ridges 68. It will be appreciated that after the quadrants 71 of ring portion 70 are received in groove portion 72, the turning action induced by ridges 68 produces sufficient momentum that forward member 48*a* continues to turn slightly after reaching should portion 59*a* so that a distal end 76 of ring portion 70 then moves circumferentially behind the corresponding shoulder portion 74 (located on the opposite side to shoulder portion 59*a*) to positively trap (as by a twist-lock) ring portion 70 in groove portion 72.

In operation, projectile 60 functions in essentially the same manner as projectile 40, with the exception that the movement of forward member 48*a* from the contracted position to the extended is caused or facilitated by the ignition of propellant 64. In addition, forward member 48*a* undergoes a turning action induced by ridges 68 as the quadrants 71 of ring portion 70 are received into the openings 73 of groove portion 72 so that the quadrants 71 are subsequently twist-locked behind shoulder portions 74 of groove portion 72.

Figure 6:
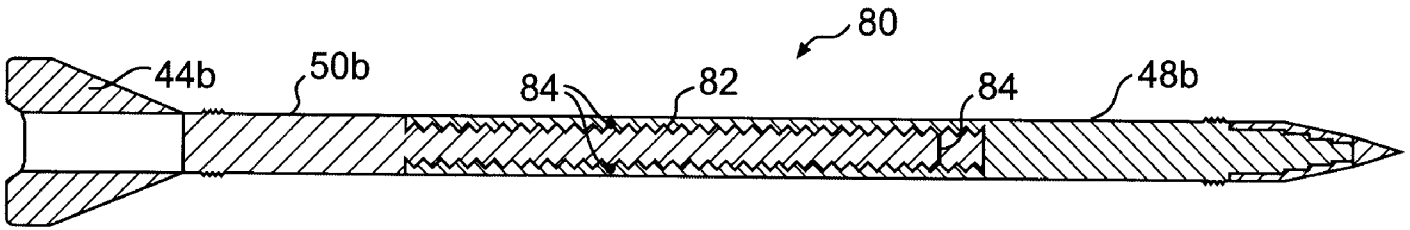
FIG. 6 is a cross-sectional side elevation view of the third projectile of FIG. 4 before firing.
Figure 7:
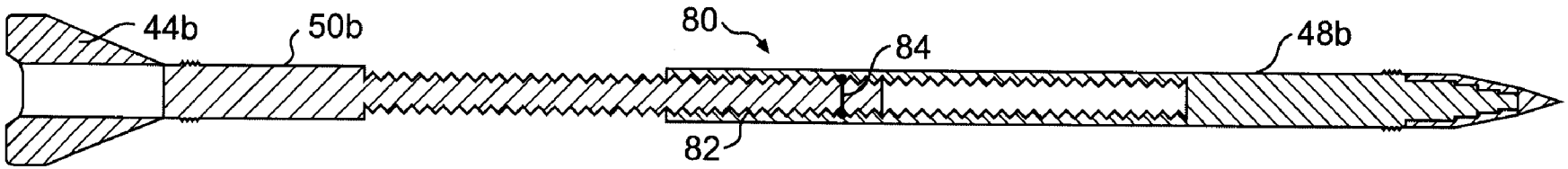
FIG. 7 is a cross-sectional side elevation view of the third projectile shown in FIG. 6 after firing.

Depicted in FIGS. 6 and 7 is a projectile 80 in accordance with a third embodiment of the present invention. Projectile 80 is broadly similar to projectiles 40 and 60, so that the same elements have been identified with the same numerals but with an added "b", and consequently such elements are not discussed further. It will be appreciated that the connection between forward member 48*b* and rearward member 50*b* in this embodiment is mating threads 82 rather than a simple sliding fit as in projectiles 40 and 60. In order to move forward member 48*b* forwards relative to rearward member 50*b* after firing as shown in FIG. 7, rear 44*b* has fins which act as a spinning mechanism to impart a spin to projectile 80 during flight. The spin of projectile 80 caused by rear 44*b* is in one direction which is opposite to a thread direction of threads 82, so that during flight forward member 48*b* threadably moves away from rearward member 50*b*.

The forward movement of forward member 48*b* is stopped by use of a thread lock 84 which is only schematically depicted. Thread lock 84 can be of any of the various types known in the mechanical arts such as the schematically depicted spring loaded pins (two pins separated by a spring and located in rearward member 50*b* and mating holes located in forward member 48*b* at the desired stopping point of the pins, so that the pins push out and engage the holes when reached), stop threads, flat pieces or portions, or the like.

Figure 8:
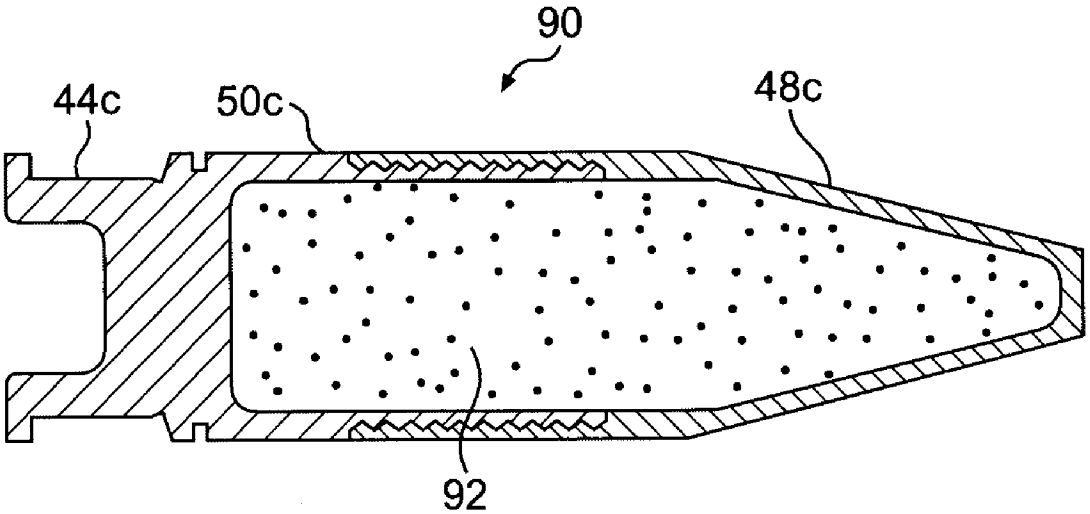
FIG. 8 is a cross-sectional side elevation view of a fourth projectile prior to firing.
Figure 9:
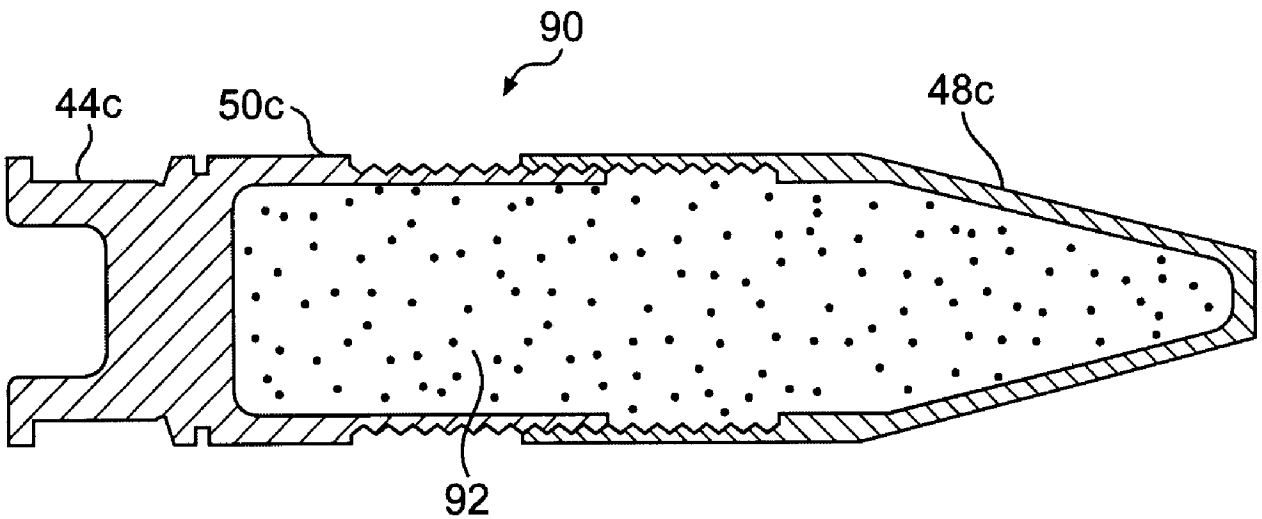
FIG. 9 is a cross-sectional side elevation view of the fourth projectile shown in FIG. 8 after firing.

Depicted in FIGS. 8 and 9 is a projectile 90 in accordance with a fourth embodiment of the present invention. Projectile 90 is broadly similar to projectiles 40, 60 and 80, so that the same elements have been identified with the same numerals but with a added "c", and consequently such elements are not discussed further. It will be appreciated that the projectile 90 is shaped for use as a tank or artillery projectile and is made of typical materials thereof and has a standard length as appropriate and known. Like projectile 80, projectile 90 spins due to rear 44*c* (as by fins, a cone or a stabilizer, which are all known in the art) so that forward end 48*c* moves from the contracted to the extended position as shown by the difference between FIGS. 8 and 9. In this embodiment, located inside of projectile 90 is a reinforcing member 92. Reinforcing member 92 is schematically depicted and comprises an expandable foam or plastic material which expands as forward member 48*c* moves away from rearward member 50*c* to fill the space therebetween as schematically shown.

In operation, reinforcing member 92 serves to help prevent the walls of forward member 48*c* and rearward member 50*c* from collapsing during flight. In addition, reinforcing member also serves to promote a bowing out of the walls of forward member 48*c* and rearward member 50*c* when contact is first made with the target (see FIG. 11A discussed subsequently). This results in the cross-sectional profile of projectile 90 increasing, so that projectile 90 produces a larger hole when it passes through a target. Thus, the use of explosive projectiles which may damage the structural integrity of a target can be avoided.

In another embodiment, reinforcing member 92 can also be an explosive.

In still another embodiment, the reinforcing member could be a metal or composite cylinder (not shown) that is attached to the forward end of rearward member 50*c*.

Figure 10A:
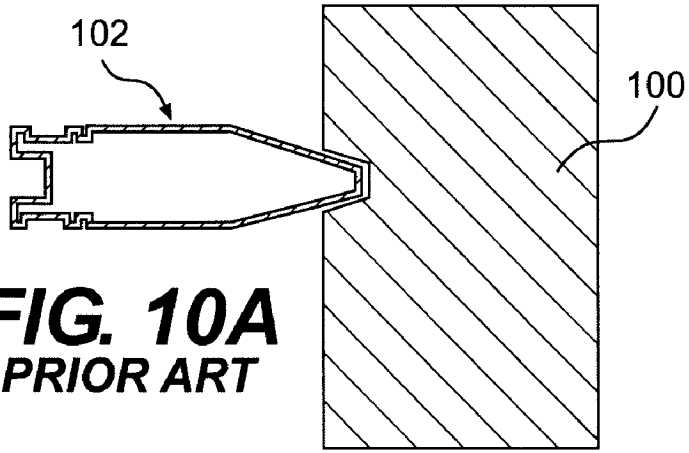
FIG. 10A PRIOR ART
FIGS. 10A and 10B schematically depict a prior art projectile as it respectively contacts and penetrates a wall.
Figure 10B:
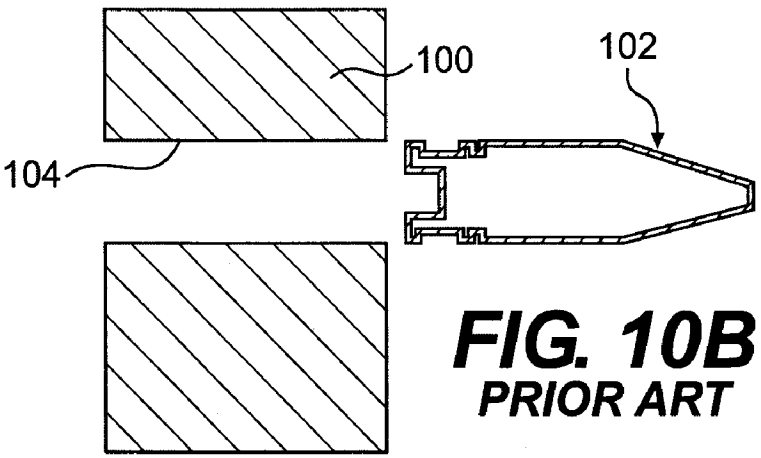
FIG. 10B PRIOR ART

Depicted schematically in FIGS. 10A and 10B is the penetration of a wall 100 achieved by a prior art tank projectile 102 which has no explosive. It will be seen that the diameter of hole 104 produced is about the size of the diameter of projectile 102.

Figure 11A:
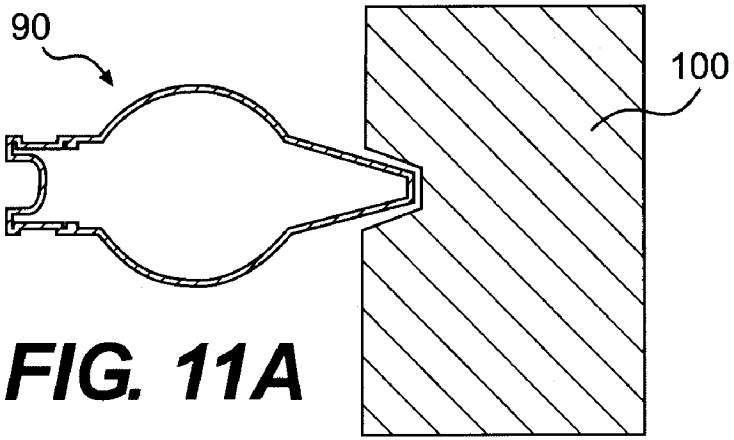
FIGS. 11A and 11B schematically depicts the projectile of FIG. 8 as it respectively contacts and penetrates a wall.
Figure 11B:
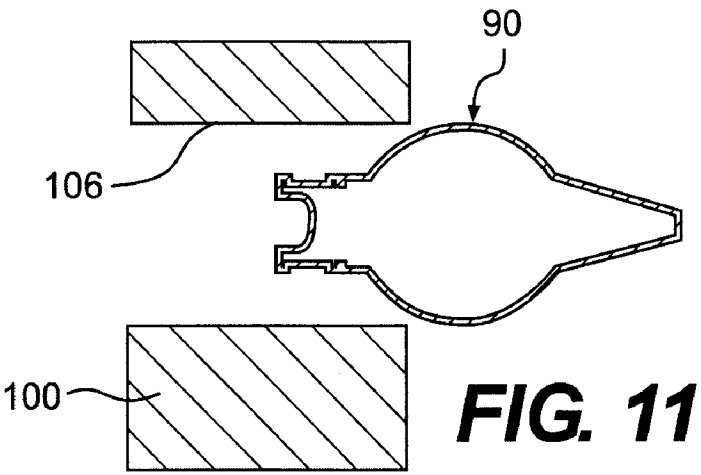

Depicted schematically in FIGS. 11A and 11B is the penetration of the same wall 100 by tank projectile 90 of the present invention. As shown in FIG. 11A, upon contact with wall 100, the lateral walls of the rod of projectile 90 bow outward, increasing the diameter of projectile 90 substantially. Thus, as shown in FIG. 11B, hole 106 produced in wall 100 by extended rod projectile 90 is increased in size relative to hole 104.

This increase in hole size is important, for example, where projectiles are fired at walls to create holes so that soldiers can get through the walls. While prior art projectiles using explosives could be used for bigger holes in walls, the integrity of the wall or the building may be compromised, so that is not always a good option. Further, the larger hole created by the projectile 104 allows for fewer shots to be fired at the wall to create a large enough access hole for the soldiers to get through as compared to projectile 102.

While various preferred embodiments of the invention have been described above, other equivalent mechanical operators or constructions can be employed. For example, the connection between the forward and rearward members could be other than a piston/cylinder (including screw) type, such as where the inner member is "X"(or with any number of arms extending from a central base) shaped in cross section and mating with a correspondingly shaped outer member. Similarly, mating quadrants could be used. It will also be appreciated that the connection can be reversed, for example with the rearward member received in the forward member rather than the reverse as depicted in the figures, or with neither member being considered as being received in the other (or both equally received in each other).

The use of a reinforcing member in the cavity created between forward members 48 and rearward members 50 is also usable in the projectiles other than projectile 90, and in particular in projectiles 40, 60 and 80. Such reinforcing members could additionally be members which are H shaped and which expand when the cavity is increased. Such reinforcing members could be tack welded in place so as not to move as forward member moves to the extended position, but not so securely attached that bowing is prevented. The reinforcing members could also be threaded portions, grooves or raised portions (and thus the threads of projectile 80 also serve this function), or even collars or the like embedded in one or the other or both of forward members 48 and rearward members 50. An expandable metal or composite spider (expandable web) or the like could also be used which would expand as the cavity is created but which would be non-continuous and hence light.

While rifle, tank and mortar projectiles have been depicted and described, it will be appreciated that all small, medium and large projectiles for rifles, tanks, artillery and mortars can benefit from the rod lengthening technique of the present invention.

It is also anticipated that another use of an extended rod would be to provide an area of expansion for two part explosives that mix and expand. In addition, the use of an extended rod may have application for thermobaric type explosives that could benefit by the increased volume of the projectile during flight.

Thus, while the present invention has been described with respect to exemplary embodiments thereof, it will be understood by those of ordinary skill in the art that other variations and modifications can be effected within the scope and spirit of the invention.

The invention claimed is:

1. An axia kinetic energy projectile comprising:

a nose provided at a forward end of the projectile;

a rear provided at a rearward end of the projectile; and a base rod provided between said nose and said rear, said base rod including;

a forward member integral with said nose, a rearward member integral with said rear, a connection between said forward member and said rearward member which allows said forward member to move axially relative to said rearward member from a contracted position where said rod has a reduced length to an extended position where said rod has an increased length greater than the contracted length, wherein said connection includes a portion of one of said forward member and said rearward member which is received axially within a portion of the other, and wherein said connection is a sliding fit of said portions of said rearward and forward members, and;

a locking mechanism which axially locks said forward member and said rearward member together when said forward member is moved from the contracted position to the extended position, wherein said locking mechanism includes: an enlarged part of one of said portions of said rearward and forward members, and a reduced part of the other of said portions of said rearward and forward members in which said enlarged part is received when said forward member is moved from the contracted position to the extended position, and wherein said locking mechanism further includes a stop at a forward end of said reduced part which stops the forward movement said enlarged part, wherein said locking mechanism further includes: a twisting means for inducing a twist between said forward member and said rearward member as said forward member is moved to the extended position; and a second stop spaced rearwardly from said first-mentioned stop behind which said enlarged part is received and then twisted circumferentially as said enlarged part engages said first-mentioned stop.

2. An axial kinetic energy projectile comprising:

a nose provided at a forward end of the projectile;

a rear provided at a rearward end of the projectile: wherein said rear includes a spinning mechanism which spins the projectile after firing in one spill direction;

a base rod provided between said nose and said rear, said base rod including;

a forward member integral with said nose, a rearward member integral with said rear, a connection between said forward member and said rearward member which allows said forward member to move axially relative to said rearward member from a contracted position where said rod has a reduced length to an extended position where said rod has an increased length greater than the contracted length, wherein said connection includes a portion of one of said forward member and said rearward member which is received axially within a portion of the other, and wherein said connection is respective mating threads on said portions of said rearward and forward members which have a thread direction opposite to that of the spin direction so that after firing the spinning mechanism causes said forward member to be threadably moved from the contracted position to the extended position, and a locking mechanism which axially locks said forward member and said rearward member together when said forward member is moved from the contracted position to the extended position.

3. A kinetic energy projectile as claimed in claim 2: wherein said locking mechanism is a thread lock.

* * * * *